United States Patent [19]

Bratkowski et al.

[11] 4,336,516

[45] Jun. 22, 1982

[54] CIRCUIT BREAKER WITH STORED ENERGY TOGGLE-LOCK STRUCTURE

[75] Inventors: Walter V. Bratkowski, McKeesport; John A. Wafer, Brighton Township, Beaver County; James P. Ellsworth, Beaver, all of Pa.

[73] Assignee: Westinghouse Electric Corp., Pittsburgh, Pa.

[21] Appl. No.: 135,551

[22] Filed: Mar. 31, 1980

[51] Int. Cl.[3] ..... H01H 9/24

[52] U.S. Cl. ..... 335/171; 335/26; 335/192; 200/153 SC

[58] Field of Search ..... 335/171, 10, 15, 26, 335/167, 168, 169, 192; 200/153 SC, 321, 322

[56] References Cited

U.S. PATENT DOCUMENTS

| | | | |
|---|---|---|---|
| 3,622,134 | 5/1972 | Cellerini | 200/146 R |
| 3,808,567 | 4/1974 | Maier | 335/167 |
| 4,166,205 | 8/1979 | Maier et al. | 200/153 SC X |

*Primary Examiner*—L. T. Hix
*Assistant Examiner*—Stafford D. Schreyer
*Attorney, Agent, or Firm*—L. P. Johns

[57] ABSTRACT

A circuit breaker characterized by a toggle lock means for holding toggle springs in a charged condition ready for closing a circuit through the circuit breaker contacts when necessary.

6 Claims, 10 Drawing Figures

CIRCUIT BREAKER WITH STORED ENERGY TOGGLE-LOCK STRUCTURE

CROSS-REFERENCE TO RELATED APPLICATIONS

This application is related to the copending application of Aldred E. Maier, Louis N. Ricci, and Charles E. Haugh, Ser. No. 102,047, filed Dec. 10, 1979.

BACKGROUND OF THE INVENTION

1. Field of the Invention

This invention relates to a circuit breaker and, more particularly, it pertains to a stored energy mechanism therefore which is operable either manually or electrically.

2. Description of the Prior Art

The basic functions of circuit breakers are to provide system protection and coordination whenever abnormalities occur on any part of an electrical system. The operating voltage, continuous-current, frequency, short circuit interrupting capability and time-current coordination needed are some of the factors which must be considered when designing a circuit breaker. Government and industry are placing increased demands upon the electrical industry for interrupters with improved performance in a smaller package and with other new and novel features.

Many new features have been developed which can be added to interrupters which can improve system performance, reliability, and flexibility, but at increased costs. Economic considerations and the choice of system components determine the degree of protection and coordination which can be incorporated into an interrupter.

SUMMARY OF THE INVENTION

In accordance with this invention a circuit interrupter includes an insulating housing containing a circuit breaker structure having contact means for opening and closing an electric circuit. The structure includes an operating lever and a releasable trip member. A toggle linkage comprises a pair of pivotally connected links and a tension spring which linkage is connected between the means and the operating lever and trip member for opening and closing the contact means. The operating lever moves to charge the spring in anticipation of opening the contact means. More particularly, a releasable trip member is provided to hold the contact means in a partially open condition when the spring is charged.

The advantage of the device of this invention is that it provides a high interruption stored energy circuit breaker which is operable either manually or electrically (by remote control) whereby increased interrupting capability is provided.

DESCRIPTION OF THE PREFERRED EMBODIMENT

Figure 2:
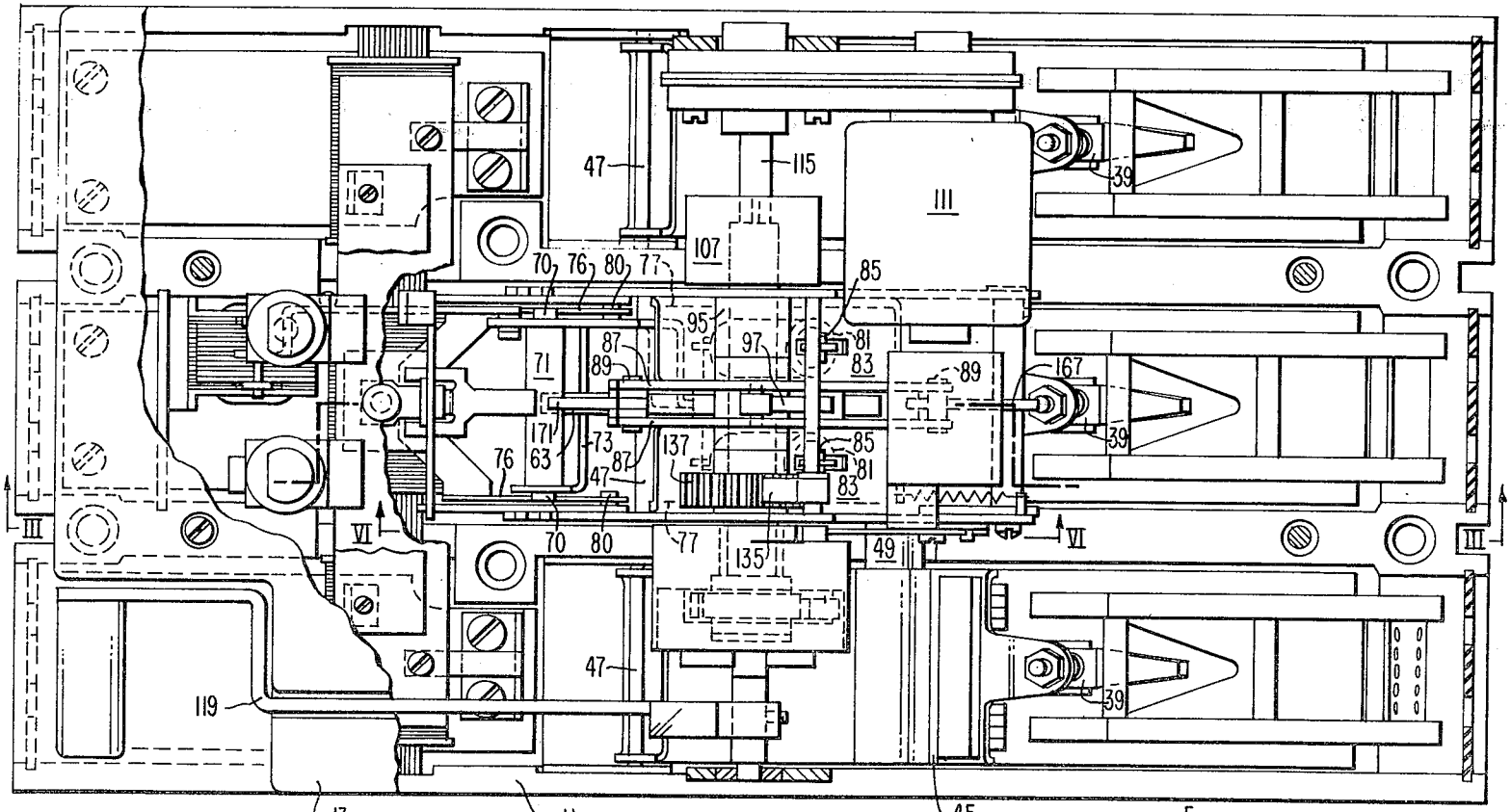
FIG. 2 is a plan view of the circuit breaker having the top cover broken away.
Figure 3:
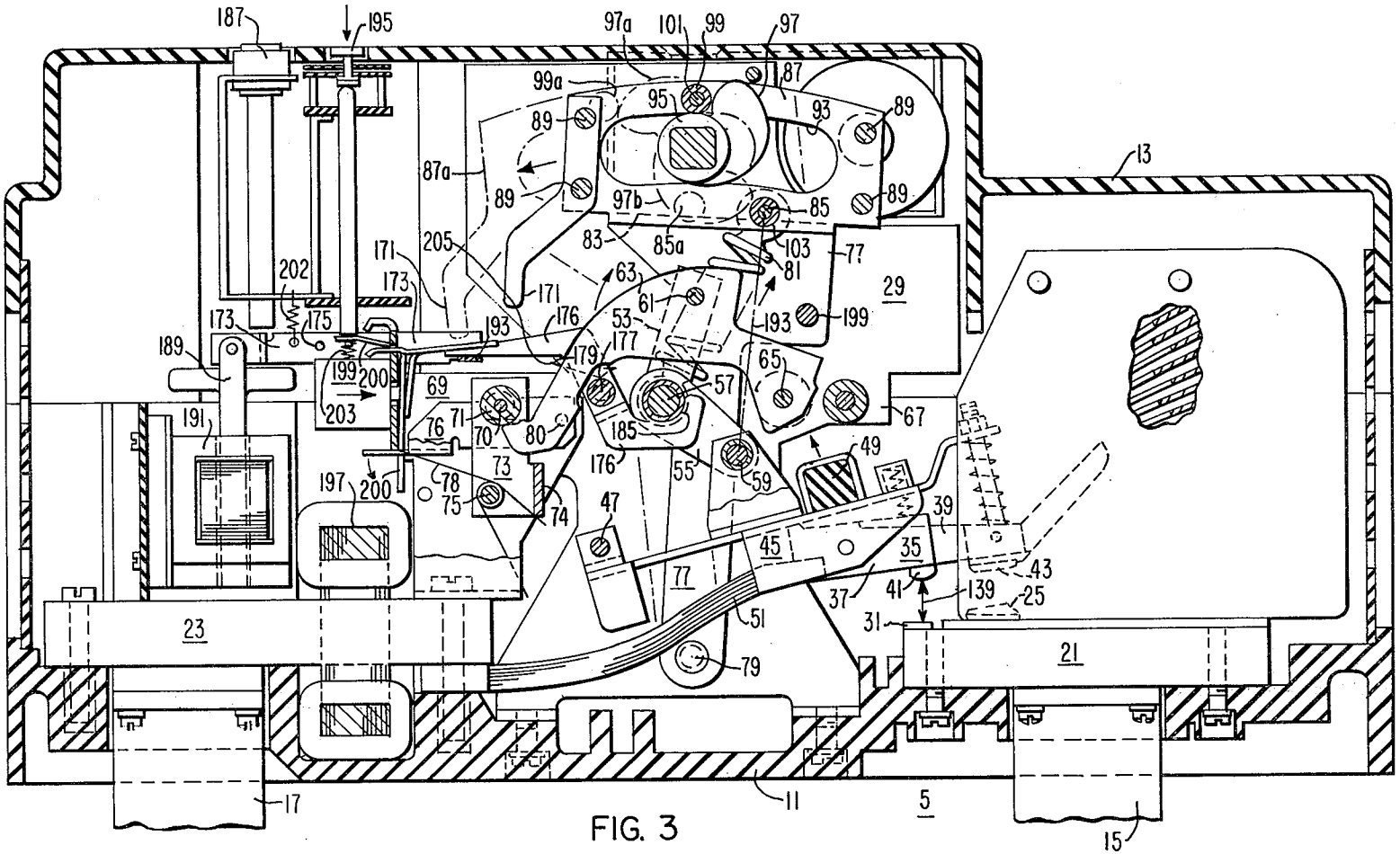
FIG. 3 is a vertical sectional view taken on the line III—III of FIG. 2 showing the circuit breaker in the open-charged position.

In FIGS. 2 and 3 a center pole unit of a 3-pole molded-case or insulating, housing-type circuit breaker 5 is shown. Trip means for the circuit breaker is more specifically set forth in U.S. Pat. No. 3,808,567. The device of this invention differs from that shown in said patent in the manner and structure by which the circuit breaker is charged and discharged.

The circuit breaker 5 comprises an insulating housing having a molded insulating base 11 and a molded insulating cover 13. Suitable insulator barrier means separate the housing 11, 13 into three adjacent insulating compartments for housing the three pole units of the 3-pole circuit breaker in a manner well known in the art. in each pole unit, two terminals 15 and 17 are provided at openings in the base 11 in proximity to the opposite ends of the housing to enable connection of the circuit breaker in an electric circuit.

In each of the three pole-unit compartments of the circuit breaker, there are two spaced conductors 21 and 23 suitably mounted on the base 11. The terminal 15 is secured to the undersurface of the conductor 21. The stationary contact 25 is fixedly secured on the conductor 21. The terminal 17 is secured to the conductor 23.

A single stored-energy type operating mechanism 29, for controlling all three pole units, is mounted in the center pole unit compartment of the circuit breaker. In addition to the stationary contact 25, a stationary contact 31 is mounted on the conductor 21. The operating mechanism 29 is operable to move a movable contact structure 35 between open and closed positions. The movable contact structure 35 is of the type more specifically described in U.S. Pat. No. 3,662,134, and comprises a plurality of main bridging contact arms 37 and an arcing contact arm 39. A movable contact 41 is mounted on the contact arm 37 and an arcing contact 43 is on the arm 39 and cooperable with the contact 25. The contact structure 35 is supported on a contact carrier 45 which is pivotally mounted at 47. A rigid insulating tie bar 49 extends across all three pole units and is connected to the three contact carriers 45 to simultaneously move the three contact carriers between open and closed positions. A flexible conductor 51 extends between the contact arm 37 and the conductor 23.

Accordingly, when the circuit breaker 5 is in the closed position (FIG. 4) a circuit through the circuit breaker extends through the parts 17, 23, 51, 37, 41, 31, 21 and 15. The circuit also passes through the arcing contacts 25, 43.

Figure 5:
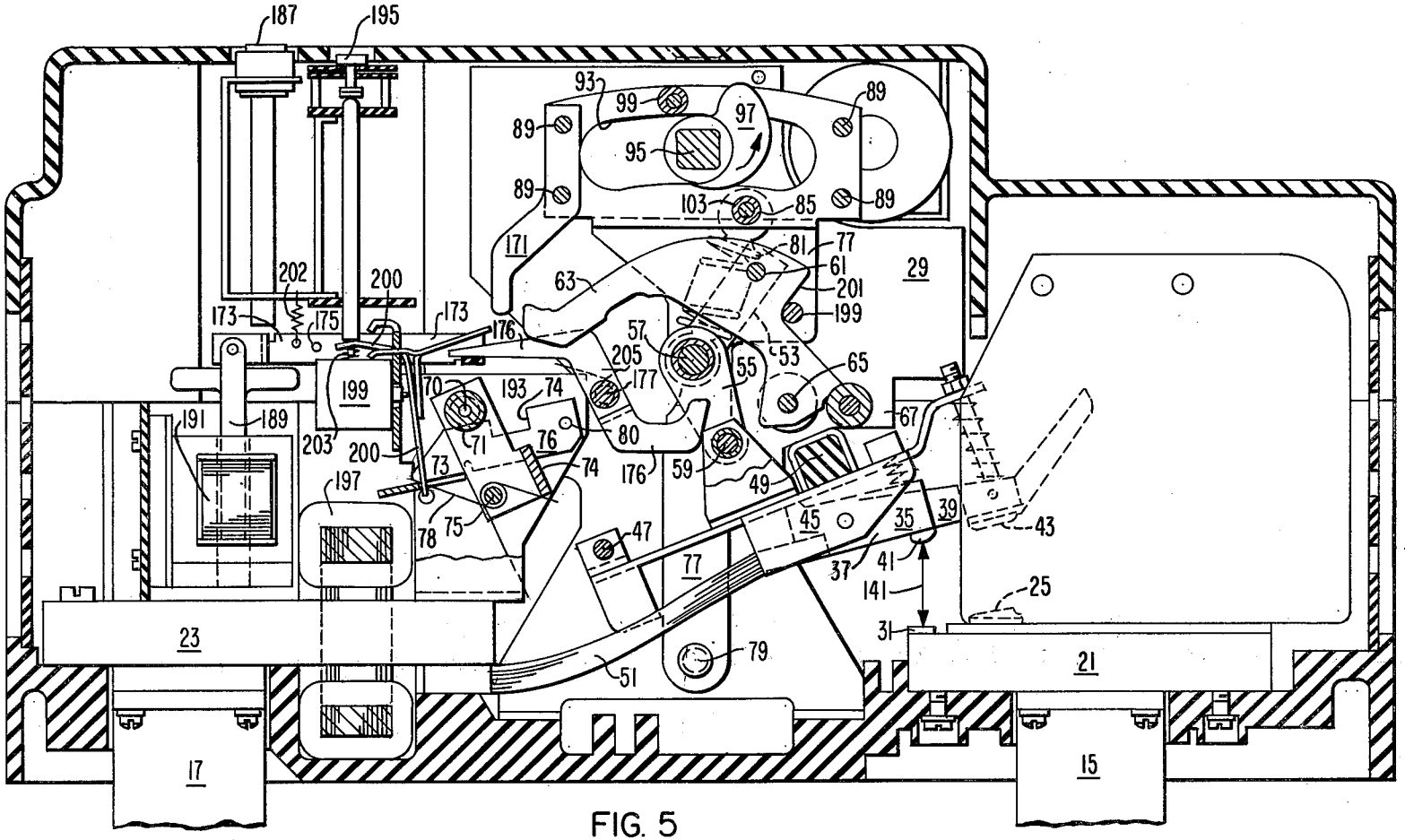
FIG. 5 is a vertical sectional view similar to FIG. 3 showing the circuit breaker in the open-discharge position.

The operating mechanism 29, comprises a toggle unit having upper and lower toggle links 53, 55 which are pivotally connected by a knee pivot pin 57. The lower link 55 is pivotally connected to the contact carrier 45 by a pin 59. The upper toggle link 53 is pivotally connected at 61 to a releasable trip member 63 which is, in turn, pivotally mounted at pivot pin 65 on a mounting frame 67. The left end of the releasable trip member 63 (FIG. 3) is latched by a latch structure 69, the construction and operation of which is more particularly set forth in Pat. No. 3,808,567. Suffice it to say the latch structure 69 comprises a latch roller 71 which is mounted on a latch lever 73, the lower end of which is pivotally mounted at 75, whereby upon tripping of the circuit breaker 5 the latch lever 73 rotates counterclockwise to move the latch roller 71 out of the latch position resulting in tripping of the circuit breaker as shown in FIG. 5.

An inverted generally U-shaped operating lever 77 is supported on the inner sides of legs thereof for pivotal movement on a pair of fixed pins 79. Tension springs 81 are connected at the lower ends thereof to the knee pivot pin 57 and at the upper ends thereof to a bight portion 83 on spaced pins 85 of the lever 77.

Figure 9:
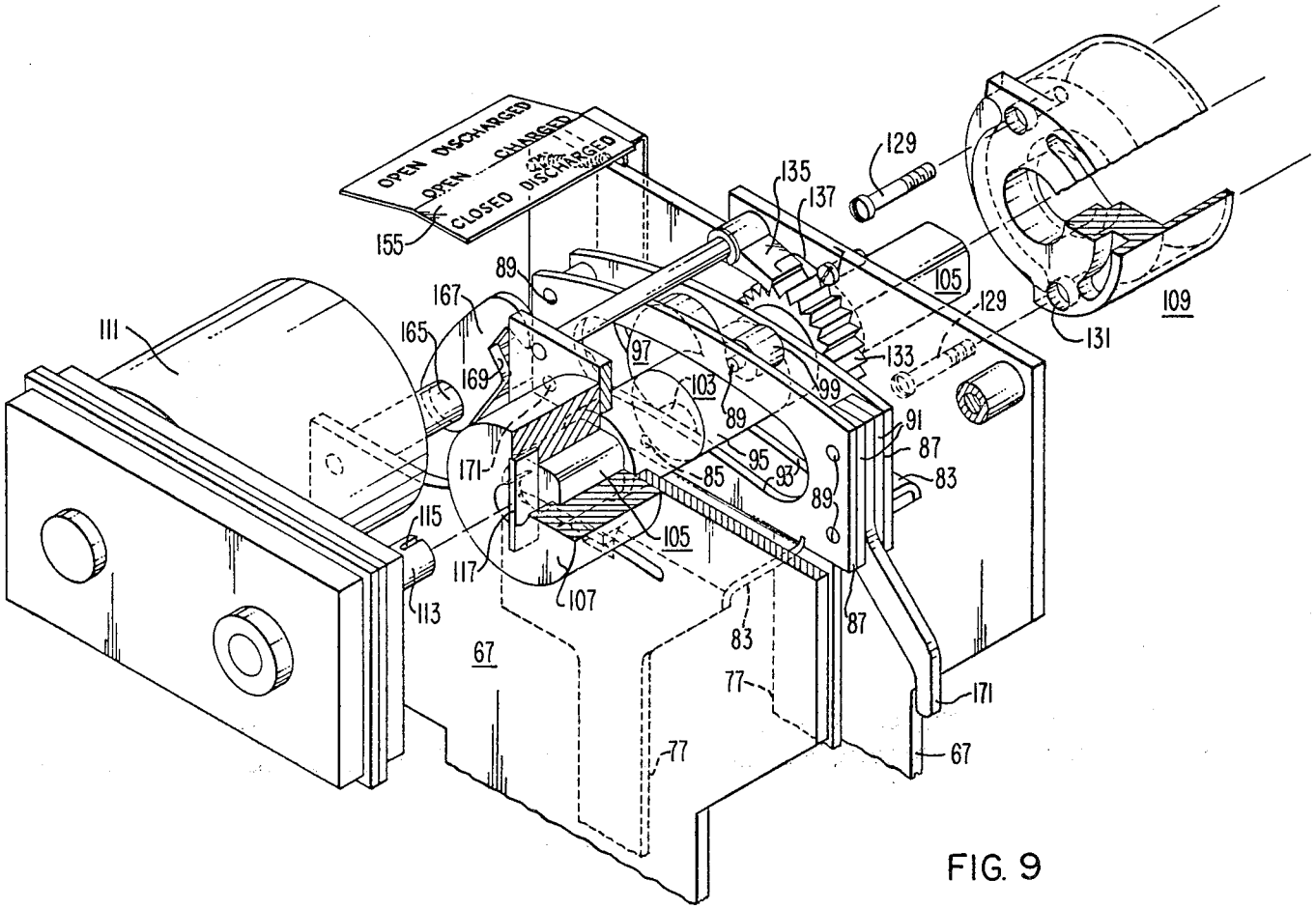
FIG. 9 is a schematic view with some parts exploded of the charging device of this invention.

As shown in FIGS. 2, 3, 9 each bight portion 83 includes an upturned flangelike member 87 to provide a pair of such members which are rigidly secured together by suitable means, such as rivets 89, and spacer means 91 at opposite ends thereof (FIG. 9). Each member 89 comprises an arcuate slot 93 aligned with the corresponding slot of the other member.

Moreover, in accordance with this invention the circuit breaker 5 comprises means for charging the tension springs 81 in the open-charged position (FIG. 3). The means for charging springs 81 comprises a rotatable shaft 95 (FIG. 9) which extends through the arcuate slots 93 and which includes a cam plate 97 fixedly mounted on the shaft. The charging mechanism also includes a cam roller 99 on a pin 101 between the flangelike members 87. Another cam roller 103 is mounted on the pin 85 between the flangelike members 87 and below the arcuate slots 93. Similar opposite end portions 105 of the shaft 95 have a noncircular or square cross section on which a coupling 107 is mounted at one end (FIG. 9) and a clutch 109 is mounted at the other end. Thus, the shaft 95 may be driven either electrically through the coupling 107 or manually through the clutch 109. For electric driving a motor 111 drives a shaft 113 which has an end slot 115 for engagement with a member 117.

Figure 10:
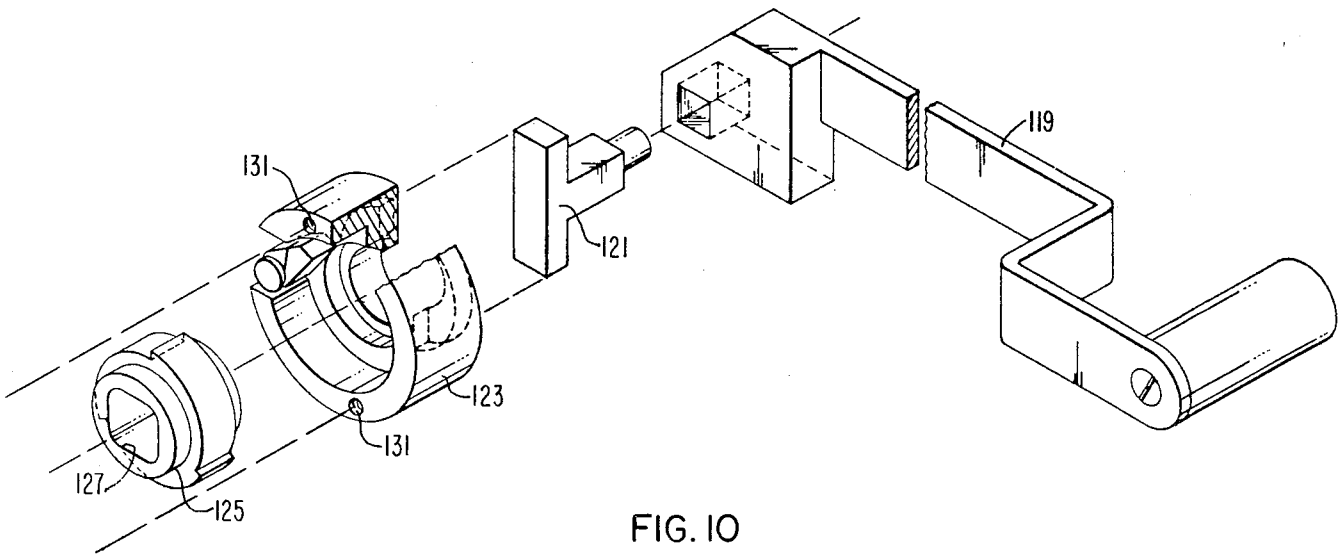
FIG. 10 is an exploded view of the manual crank assembly for charging the circuit breaker.

The shaft 95 is rotated manually by a handle 119 (FIG. 10) which is mounted on an adapter 121 which is seated within one end of a ring 123 of a pawl clutch which includes an inner member 125 having a square bore 127 in which the squared end portion 105 is seated. Bolts 129 engaging threaded holes 131 hold the assembly of the pawl clutch together. Accordingly, the shaft 95 may be rotated either electrically or manually to charge the springs 81. When the shaft 95 is rotated a ratchet wheel 133, fixedly mounted on the shaft, functions with a pawl 135 for retaining the shaft in position. A wire spring 137 retains the pawl 135 in place against the ratchet wheel 133.

Figure 1:
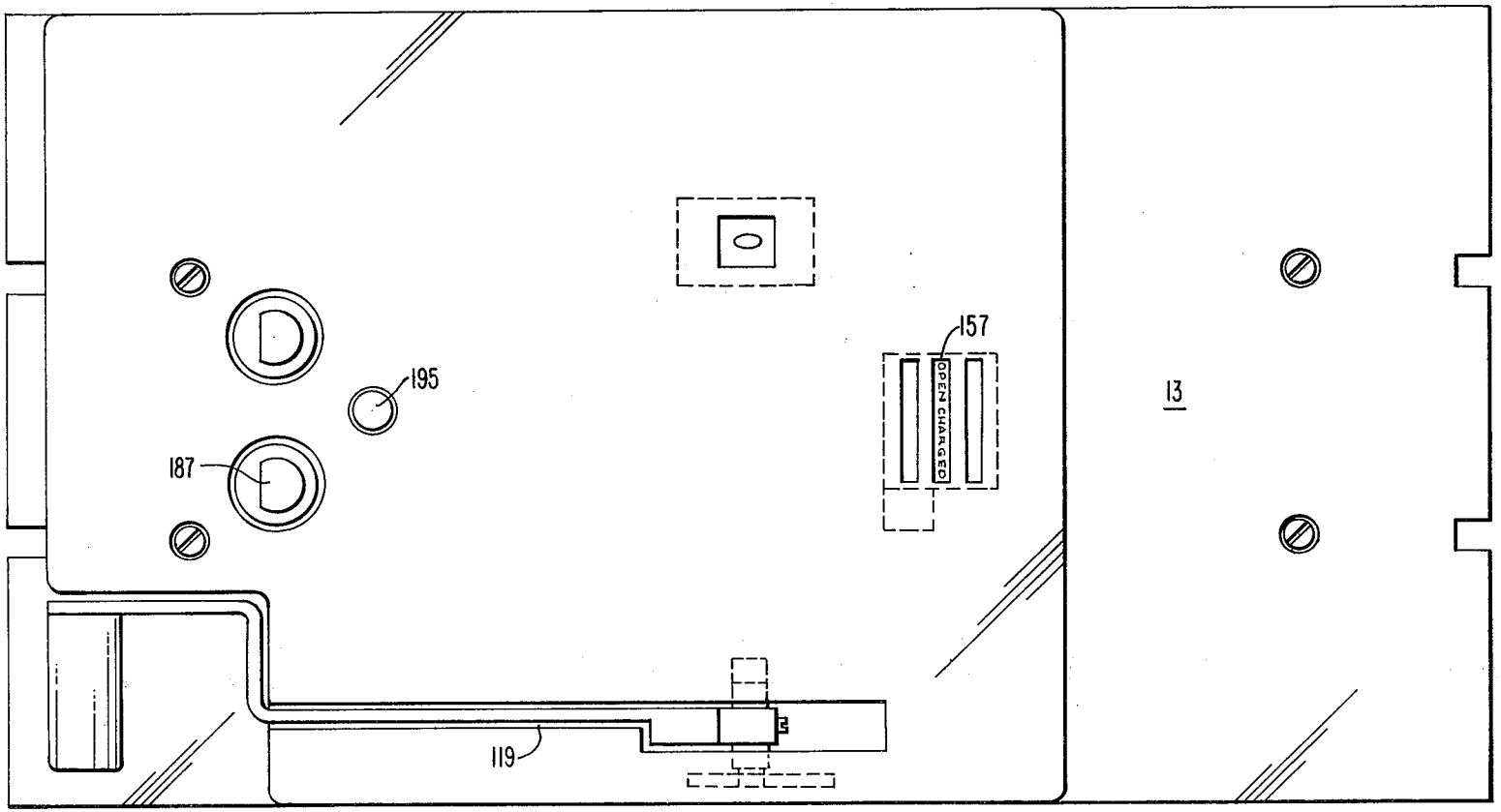
FIG. 1 is a plan view of a circuit breaker in accordance with this invention.
Figure 8:
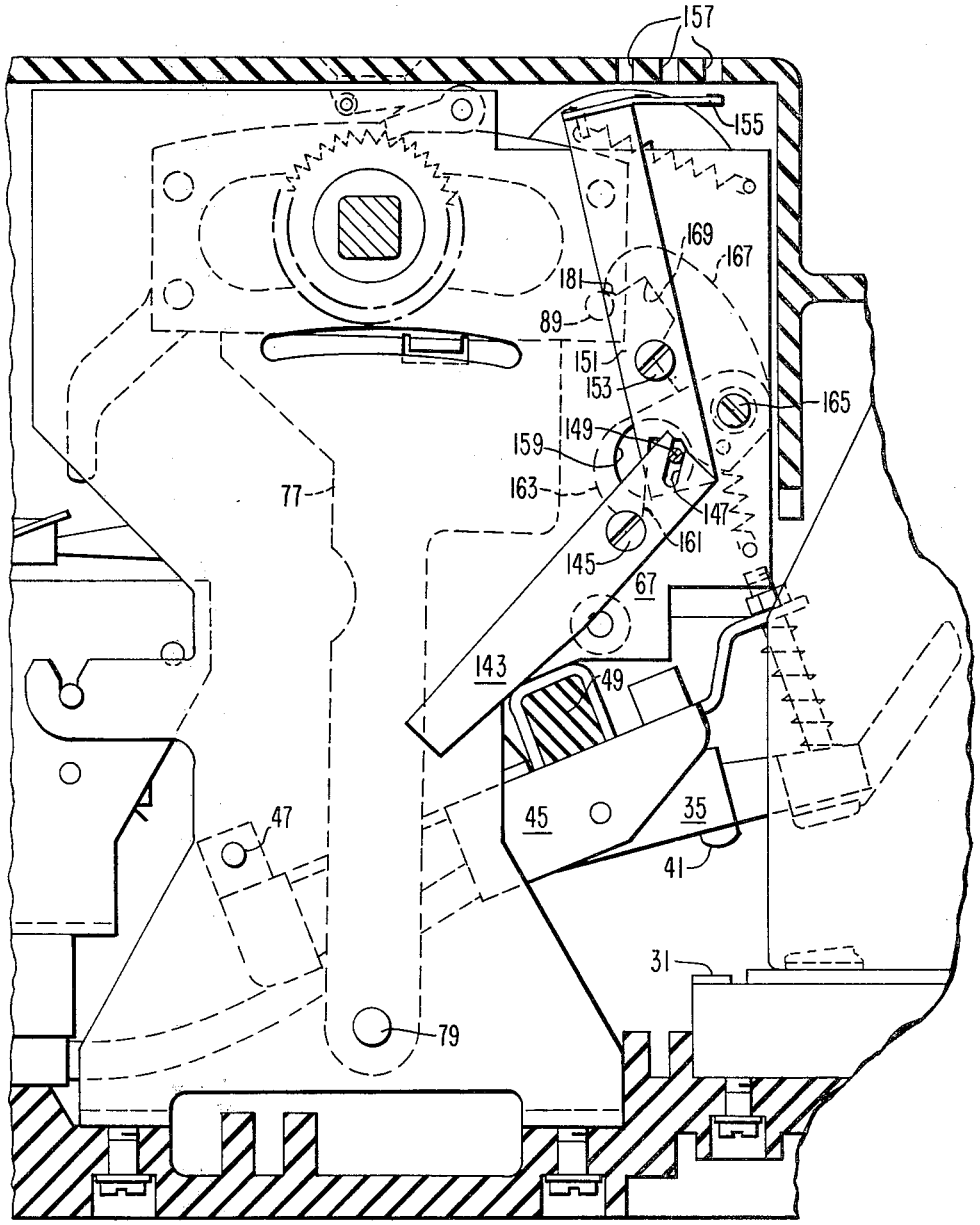
FIG. 8 is an enlarged vertical sectional view taken on the line VI—VI of FIG. 2 and showing the circuit breaker in the open-discharge position.

In operation in the open-charged position (FIG. 3) the contacts 31, 41 are in a partially closed position as indicated by an arrow 139 (FIG. 3) as compared with the spacing arrow 141 between the contacts in the fully opened, discharged position (FIG. 5). In the latter position the contacts 31, 41 are fully open and the springs 81 are discharged. In that position the trip member 63 is released from a latched position under the roller 71, as shown in FIG. 5. Moreover, the tie bar 49 (FIG. 8) is elevated to a location where it holds a lever 143, pivoted at pin 145, in the position shown so that a slot 147 is disposed at an angle such that a pin 149 is disposed at the upper end of the slot. The pin 149 is mounted on a lever 151 pivoted at 153 on which a position member 155 is mounted. As shown in FIG. 9 various conditions of the circuit breaker 5 are shown on the upper side of the member 155 which positions, such as the open-charged position, are alignable with openings 157 (FIG. 1) in the top of the housing 13 of the circuit breaker.

Figure 6:
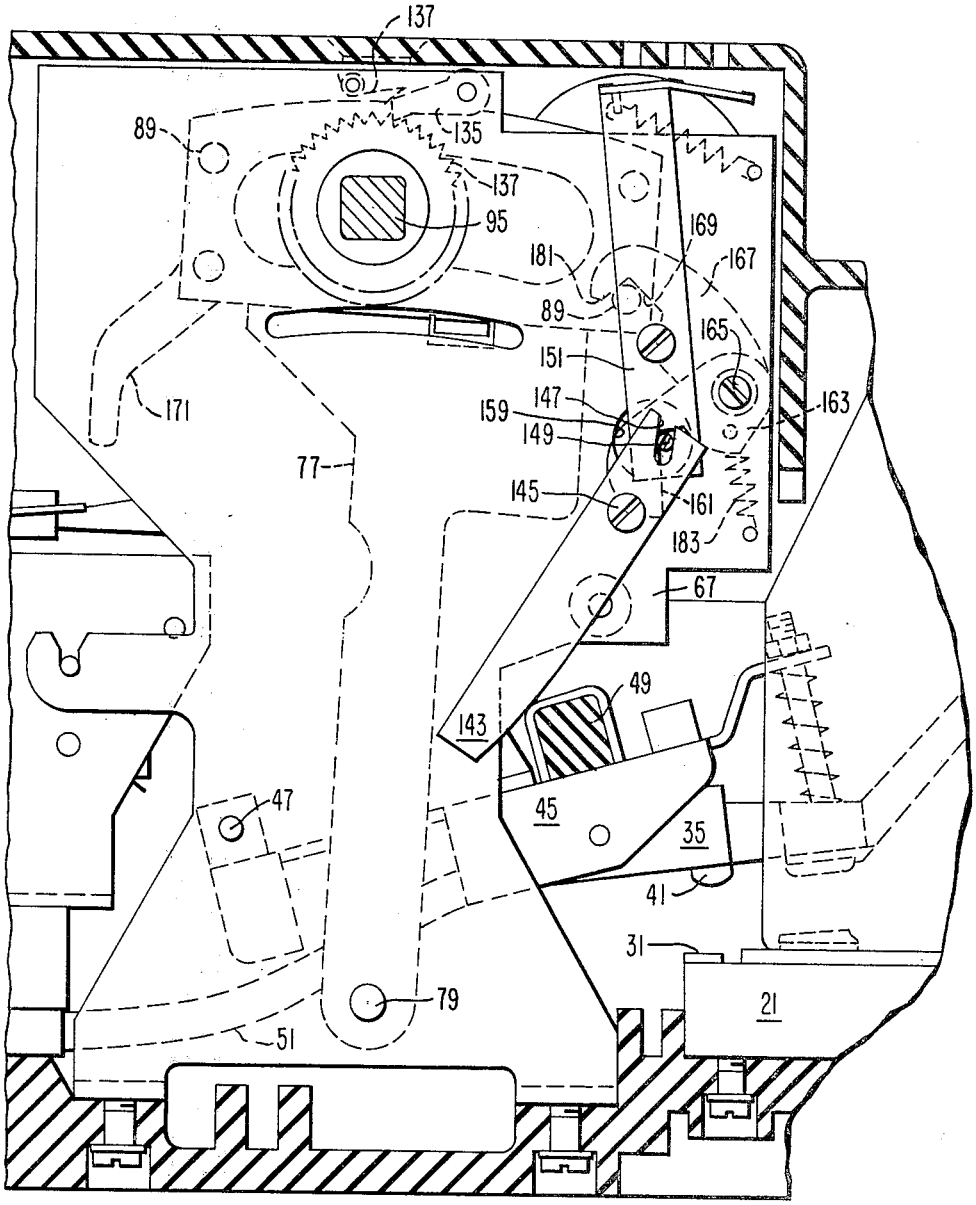
FIG. 6 is an enlarged fragmentary vertical sectional view taken on the line VI—VI of FIG. 2 showing the circuit breaker in the open-charged position similar to FIG. 3.
Figure 7:
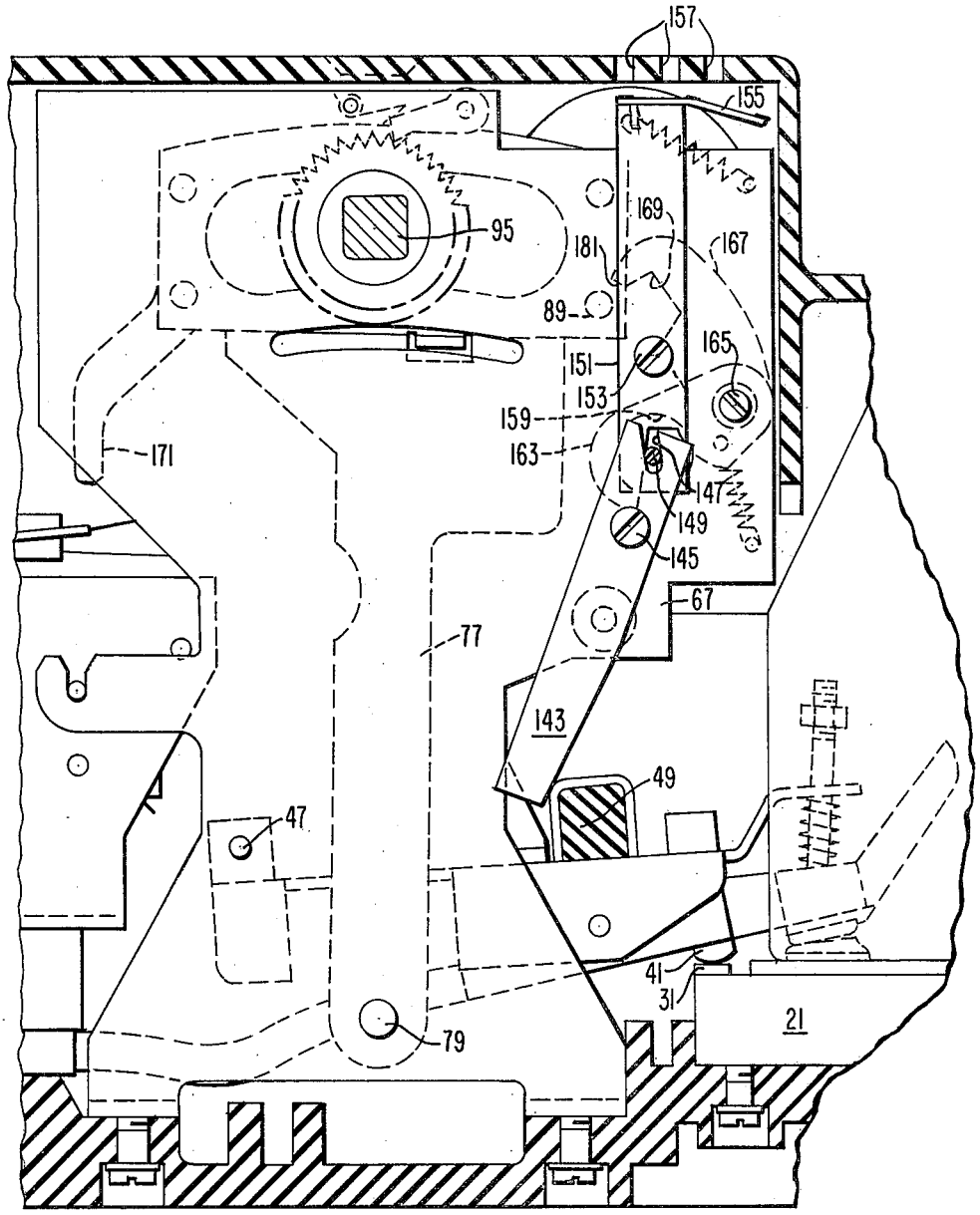
FIG. 7 is an enlarged fragmentary vertical sectional view taken on the line VI—VI of FIG. 2 and showing the circuit breaker in the closed-discharge position.

The pin 149 (FIG. 8) extends through an opening 159 in the mounting frame 67 and is adapted for operation with a notch 161 in a link 163 which is fixedly mounted on a rotatable shaft 165 on which a hook link 167 is also fixedly mounted. A notch 169 in the link 167 functions with the rivet 89 on the hook link 167. Accordingly, when the circuit breaker is in the fully open-discharge position (FIG. 8), the tie bar 49 lifts the lower end of the lever 143 and thereby raises the hook link 167 to its uppermost position so that when the charging mechanism including the flangelike member 87 is actuated to the open-charged position (FIG. 6), the pin 89 moves into a latched position in the notch 169 as shown.

Charging of the springs 81 occurs when the cam plate 97 is rotated counterclockwise by the shaft 95. As the cam 97 rotates to the broken line position **97*a* (FIG. 3) the cam roller 99 moves to the position 99*a*, thereby rotating the member 87 to the broken line position 87*a*. In that position a prong 171 depresses a lever 173 clockwise about its pivot point 175 to enable a toggle lock lever 176, which is pivoted at a pin 177, to rotate counterclockwise by a wire spring 179 to the position shown in FIG. 5**.

Continued rotation of the cam plate 97 brings it into contact with the cam roller 103 to move the flangelike member 87 clockwise to move the pin 89 (FIG. 8) under a tip 181 of the hook link 167 and further into the notch 169 (FIG. 6) where it is latched in place by a spring 183 with the contacts (FIG. 8) in the fully open position.

Further continued rotation of the cam plate 97 causes the knee pivot pin 57 to drop from the position of FIG. 5 to that of FIG. 3 where it is retained on an inclined surface 185 of the toggle lock lever 176. At the same time the contact carrier 45 lowers until the movable contact 41 is in the partially closed position (FIG. 3) with respect to the stationary contact 31. As the cam plate 97 continues to rotate past the cam roller 103 it complets a full cycle of rotation (FIG. 3). Accordingly, the springs 81 are charged and retained in the charge position by the toggle lock lever 176.

Figure 4:
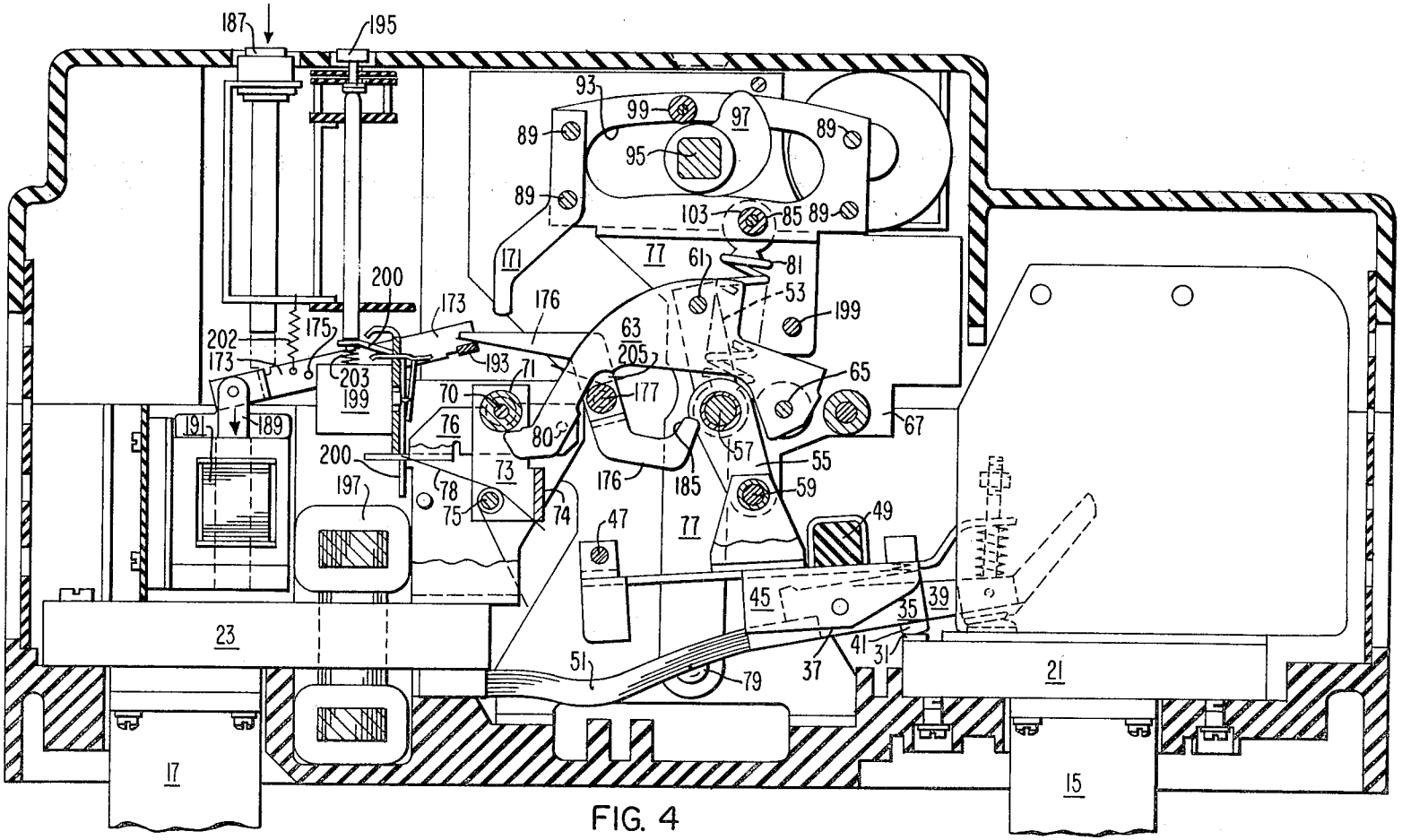
FIG. 4 is a vertical sectional view similar to FIG. 3 showing the circuit breaker in the closed-discharge position.

Closing of the contacts, as in FIG. 4, may be accomplished by either pressing a button 187 or by remote actuation of a plunger 189 of a solenoid coil 191 for rotating the lever 173 counterclockwise so that a flange 193 on the lever rotates the toggle lock lever 176 sufficiently to enable the charged springs 81 to move the pivot pin 57 against the inclined surface 185 of the lever and thereby release the pin 57 to move toward a line 193 (FIG. 3) extending between the spaced pins 59, 85, causing the contacts 31, 41 to close as shown in FIG. 4.

The trip member 63 is released either by manually pressing the button 187, or by remote control through the solenoid coil 191 and the plunger 189. That release is momentary so that a tension spring 202 resets the lever 173 to the latched position (FIG. 5), thereby raising the button 187 and the plunger 189 to their normal positions (FIGS. 3 and 5). A bias spring 205 (FIGS. 3–5) biases the lock lever 176 to the position of FIGS. 3 and 5.

Reopening of the contacts 31, 41 is accomplished either manually by pressing a button 195 or automatically when an overcurrent moves through the conductor 23 which is detected by a coil 197 which, in turn, actuates a solenoid 199 against a latch 200 to unlatch a lock latch 76 to cause the latch lever 73 to rotate the latch roller 71 from the latched position (FIG. 3) to the unlatched position (FIG. 5), whereupon the releasable trip member 63 discharges the operating mechanism 29 to the fully open position of FIG. 5.

The releasable trip member 63 is reset during charging of the spring 81. As the cam plate 97 rotates to move the member 87 to the broken line position 87*a* (FIG. 3), a pin 199 (FIG. 5) on the member 87 moves against an edge 201 of the trip member 63 to rotate the member 63 to the reset position under the latch roller 71 (FIG. 3). During that movement, as shown in U.S. Pat. No. 3,808,567, the free end of the member 63 engages the bight portion 74 of the latch lever 73 which is pivoted clockwise about the pivot 75 from the unlatched position (FIG. 5) to the latched position (FIGS. 3 and 4). Near the end of movement of the latch lever 73 the ends of an axle 70 of the latch roller 71 drop into notches 74 of spaced legs of the lock latch 76. A torsion spring 78 biases the lock latch 76 clockwise about a pivot 80 from the unlocked position (FIG. 5) to the locked position (FIGS. 3 and 4).

In conclusion, the device of the present invention provides locking means for holding toggle springs in a charged condition ready for closing a circuit through the circuit breaker contacts which are held in a partially closed position.

What is claimed is:

1. A circuit breaker comprising a housing, a circuit breaker structure in the housing and having contact means operable to open and close an electric circuit, the structure also having an operating lever and a releasable trip member, a pair of toggle links connected between the contact means and the releasable trip member, a pivot pin connecting the links together, toggle spring means extending between the pivot pin and the operating lever, the operating lever being movable to charge the toggle spring means, a toggle lock lever releasably locking the pivot pin whereby the contact means are partially closed, unlock means for unlocking the toggle lock lever to enable the contact means to close, and latch means for latching the releasable trip member in position to discharge the toggle spring means and open the circuit.

2. The circuit breaker of claim 1 in which camming means are operatively connected to the operating lever for moving the operating lever to charge the toggle spring means.

3. The circuit breaker of claim 2 in which the camming means is operable manually.

4. The circuit breaker of claim 2 in which the camming means is operable by electric drive means.

5. The circuit breaker of claim 2 in which the operating lever includes a portion extending into the path of movement of the releasable trip member so that upon movement of the operating lever during charging of the toggle spring means the releasable trip member is moved to a reset position.

6. The circuit breaker of claim 2 in which the operating lever is in the path of movement of the toggle lock lever so that the toggle lock lever is moved to a reset position during movement of the operating lever.

* * * * *